United States Patent [19]

Young, Jr. et al.

[11] Patent Number: 4,589,580

[45] Date of Patent: May 20, 1986

[54] WEB HANDLING AND ACCUMULATION SYSTEM

[75] Inventors: William O. Young, Jr.; Julian E. Hankinson, Jr., both of Spartanburg; Mansel A. Jennings, Inman, all of S.C.

[73] Assignee: Young Engineering, Inc., Spartanburg, S.C.

[21] Appl. No.: 693,968

[22] Filed: Jan. 23, 1985

[51] Int. Cl.[4] ..... B65H 20/28

[52] U.S. Cl. ..... 226/119; 226/104

[58] Field of Search ..... 226/104, 105, 108, 110–112, 226/115, 118, 119; 26/1

[56] References Cited

U.S. PATENT DOCUMENTS

| | | | |
|---|---|---|---|
| 2,431,372 | 11/1947 | Cook et al. | 226/104 X |
| 2,521,440 | 9/1950 | Bannon | 226/118 X |
| 3,332,595 | 7/1967 | Wetzler | 226/119 |
| 3,446,409 | 5/1969 | Stearns | 226/118 |
| 4,009,814 | 3/1977 | Singh | 226/119 |

*Primary Examiner*—Donald Watkins

*Attorney, Agent, or Firm*—Dority & Manning

[57] ABSTRACT

A fabric accumulation apparatus including a housing defining a fabric entrance, a fabric exit and a generally vertical fabric storage area therebetween. A gate is located along the fabric housing, being moveable between a closed and an open position. First sensors are located along the path of travel of the gate and are operatively associated with apparatus for opening and closing the gate. Second sensors are located along the path of gate travel and are operatively associated with fabric feed to control the rate of fabric feed dependent upon the height of a fabric column in the housing.

Initially, in a filling mode and with the gate closed, fabric is fed into the housing at a high rate of speed relative to fabric withdrawal speed and a fabric bundle is produced thereabove, which ultimately forces the gate to start to open. The gate is then rapidly fully opened and closed, permitting the fabric bundle to drop into the fabric storage area. When fabric builds up adequately in the storage area, the gate will not fully close and is sensed in the partial open position, at which point the sensor signals fabric feed reduced to a slow rate mode which remains so long as the fabric column interferes with opening and closing of the gate.

28 Claims, 4 Drawing Figures

WEB HANDLING AND ACCUMULATION SYSTEM

The present invention relates to an improved system for the handling of a moving web, and particularly, to an improved system for the accumulation of a web prior to feeding same to processing equipment.

In the handling of textile webs, particularly where the web has been batched or is otherwise being fed between one piece of process equipment and another, it is important for continued uniform operation to include an intermediate fabric accumulation or storage system. During high or low speed operations, temporary interruption of one piece of equipment, to sew in a further roll of fabric, for example, the accumulation system facilitates continued operation. Heretofore, fabric accumulation systems have been known and include J boxes, scrays, festoons, and the like. These prior art fabric accumulation systems include simple open containers with fabric fed into one side, stored, and fed from an opposite side as well as more complicated arrangements in which web feeding, handling, and/or control systems are incorporated in an attempt to better maintain uniformity of web feed.

The present invention represents improvement over known prior art arrangements, and is particularly pertinent to a standing J box in which a vertical column of fabric is maintained above an exit chute located at a lower end of same. This general type of accumulation system has been utilized before, though prior art versions are fraught with certain disadvantages. Particularly, during build up of fabric in the vertical body portion, the fabric is loosely deposited therein. Due to greater fabric thickness along the selvages, outer edges of the fabric pile extend above the center. Instability of the pile of fabric coupled with the higher edges allows the edges of the fabric to start to topple which, of course, brings the center of the fabric therealong. After topple of an upper fabric portion, further fabric is continually deposited into the body portion whereby the fabric becomes tangled therein. Since the fabric exits a bottom portion of the J box, fabric entanglement within the body portion interferes with proper feeding. Converse to the above noted problem, with a proper stacking of fabric in the J box the fabric exits the bottom opening or chute with the center portion leading the selvedge.

A further important consideration in the integration of fabric feed with a processing machine or accumulation between two processing machines, is the maintenance of adequate fabric accumulation prior to feeding to the second machine, irrespective of the operating speed of the second machine. Such is of course a primary objective of an accumulation system. The present invention likewise represents improvement over prior art systems insofar as the controls for the continued uniform operation over varying speed ranges.

While the prior art as generally noted above includes J boxes that are controlled to provide a predetermined column of fabric in a vertical compartment or body portion sufficient for uninterrupted feed to a subsequent or downstream processing machine, there is no known prior art that is believed to be anticipatory or suggestive of the present invention.

SUMMARY OF THE INVENTION

It is an object of the present invention to provide an improved fabric accumulation system.

Another object of the present invention is to provide an improved system for the production and control of a vertical column of fabric within a fabric accumulation system to ensure smooth and proper feeding of the fabric therefrom.

Yet another object of the present invention is to provide an improved technique for the maintenance of vertical columns of fabric in a J box fabric system.

Still further another object of the present invention is to provide an improved control system for the handling of webs between two processing machines for proper integration of the two machines.

Generally speaking the web accumulation apparatus according to the present invention comprises a housing, said housing having walls defining a vertically disposed web storage section, a web entrance at an upper end of said storage section and a web exit at a lower end of said web storage section; closure means associated with said housing and being adapted for movement between a closed position where said closure means cooperates with a portion of said housing to define a web packing area thereabove, and an open position which permits web to drop thereby; and means to move said closure means between said open and closed positions whereby when said closure means is in said closed position, web fed into said housing is packed against said closure means, and when said closure means is moved to the open position, said packed web may drop thereby into said web storage section.

More specifically, the present web or fabric handling apparatus includes a vertically disposed elongated fabric storage section defined by a housing, and preferably having an arcuate lower section to define a J. A fabric entrance is provided at an upper end of the housing with a fabric exit at a lower end of same. A column of fabric may thus be located within the storage section which will move gravitationally in a first in, first out manner to the exit as fabric is removed from the exit by a fabric withdrawal means, generally a further processing apparatus. Fabric feed means are located adjacent and above the entrance to the storage section for positively introducing fabric into same. A gate or closure means is pivotally secured to a portion of the housing or an appurtenant structure at a predetermined location below the feed means and extends across the housing. Fluid control means are associated with the gate means for opening and closing same, and is equipped with pressure adjustment means to apply a predetermined pressure against the gate. When the gate is in a closed position, a small compartment is defined in said housing above the fabric storage section in which fabric may be compacted in a uniform fashion until the force of fabric on the gate overcomes the holding pressure on same. The gate is then opened slightly, at which point the fluid control means is actuated to quickly open the gate to the full open position, and the compacted fabric bundle drops into the main storage portion of the housing. Immediately after the compacted bundle of fabric drops from the upper compartment or packing area, the gate is reclosed by the fluid control means and a further compacted fabric bundle may be produced.

In a preferred arrangement, the gate or closure means includes a plate having an arm secured thereto and extending outwardly therefrom with a counterweight secured at an outer end of the arm. The counterweight arm is pivotally secured to a portion of the housing and has the rod of a fluid cylinder secured thereto, whereby reciprocal movement of the rod causes the arm to move about its pivot point and thus move the plate between the closed and open positions. A control system is operatively associated with the fluid cylinder to properly ensure prompt and accurate operation of the gate means. Specifically, a plurality of detector means such as photocells, proximity switches, or the like are located along the pivotal path of travel of the plate, with each detector means being associated with a control circuit for the fluid cylinder. A first detector is located immediately along the return path of travel of the gate from a closed to an open position, which, once sensing that the gate has been forced open by fabric accumulated thereabove actuates the fluid cylinder to immediately retract the rod and fully open the gate, permitting the compacted fabric bundle to immediately fall thereby. A second detector means located at the end of the path of travel of the gate from a closed to an open position is actuated when the gate reaches a fully open position, and signals the fluid cylinder to extend the rod and pivot the gate to a closed position. In this fashion, the closure means is fast acting; avoids interferrence with a fabric bundle passing thereby; and avoids excess fabric passing through the open gate.

When the accumulation system of the present invention is started up, and the fabric storage section is empty, the fabric feed means operates at a speed of from about 1½ to 2 ½ times the speed at which fabric is withdrawn from the housing in order to fill the fabric storage section to a desired level. Once, however, adequate fabric is accumulated in the storage section, the gate means then will encounter the fabric and will not fully close.

Further detector means located along the path of gate travel sense the presence of the gate intermediate its open and closed position when the storage section is about full, and are operatively associated with the fabric feed means to control fabric feed into the accumulator system proportional to the speed of fabric withdrawal from the housing. Fabric feed is slowed down once the storage section is close to full and, the fabric feed means becomes a slave to the fabric withdrawal means, operating in a range of from about 95 to about 125 percent of the operating speed of the withdrawal means.

Thereafter should adequate fabric be removed from the system, the fabric feed means will return to high speed operation until further proper fabric again fills the accumulation system. Hence, as fabric moves up and down the vertical fabric storage section of the housing, the gate operation continues with the speed of fabric being fed into the housing being varied proportional to operating speeds of downstream processing apparatus.

Generally speaking the method for handling fabric in a vertically oriented fabric accumulation system, according to the present invention comprises the steps of initially feeding fabric into said system at a rate higher than the rate at which fabric is withdrawn from said system; interrupting fabric being fed at an upper portion of said system and compacting a predetermined amount of fabric into a fabric bundle thereat; releasing said compacted fabric bundle and permitting said bundle to drop into a lower portion of said system to build up a fabric column; repeating the steps of interrupting and releasing fabric flow into said lower portion of said system until said fabric column builds up to a predetermined height; and thereafter controlling the rate of fabric being fed into said system proportional to the rate of fabric being withdrawn from said system to maintain an adequate accumulation of fabric in said system.

More particularly, with the closure means in the closed position, and being held in the closed position by a fluid cylinder at a predetermined pressure, fabric is compacted thereagainst until fabric pressure on the closure means overcomes pressure in the fluid cylinder and the closure means starts to open. After initial opening, a sensor detects the opening movement and actuates the fluid cylinder to quickly, fully open the closure means whereby the fabric bundle drops therebelow. At the end of opening travel, a further sensor detects the presence of the fully open closure means and actuates the fluid cylinder to reclose same. This cycle continues until fabric build up reaches the closure means and precludes full closure of same. Third and further sensors then detect the partial openness, of the closure means, and are operatively associated with the fabric feed means to reduce high speed fabric feed and places the fabric feed means under control of the fabric withdrawal means. The fabric feed means then operates in a range of about 95 to 125 percent of the speed of the withdrawal means, dependent upon the particular intermediate sensor that is actuated.

DESCRIPTION OF THE PREFERRED EMBODIMENTS

Figure 1:
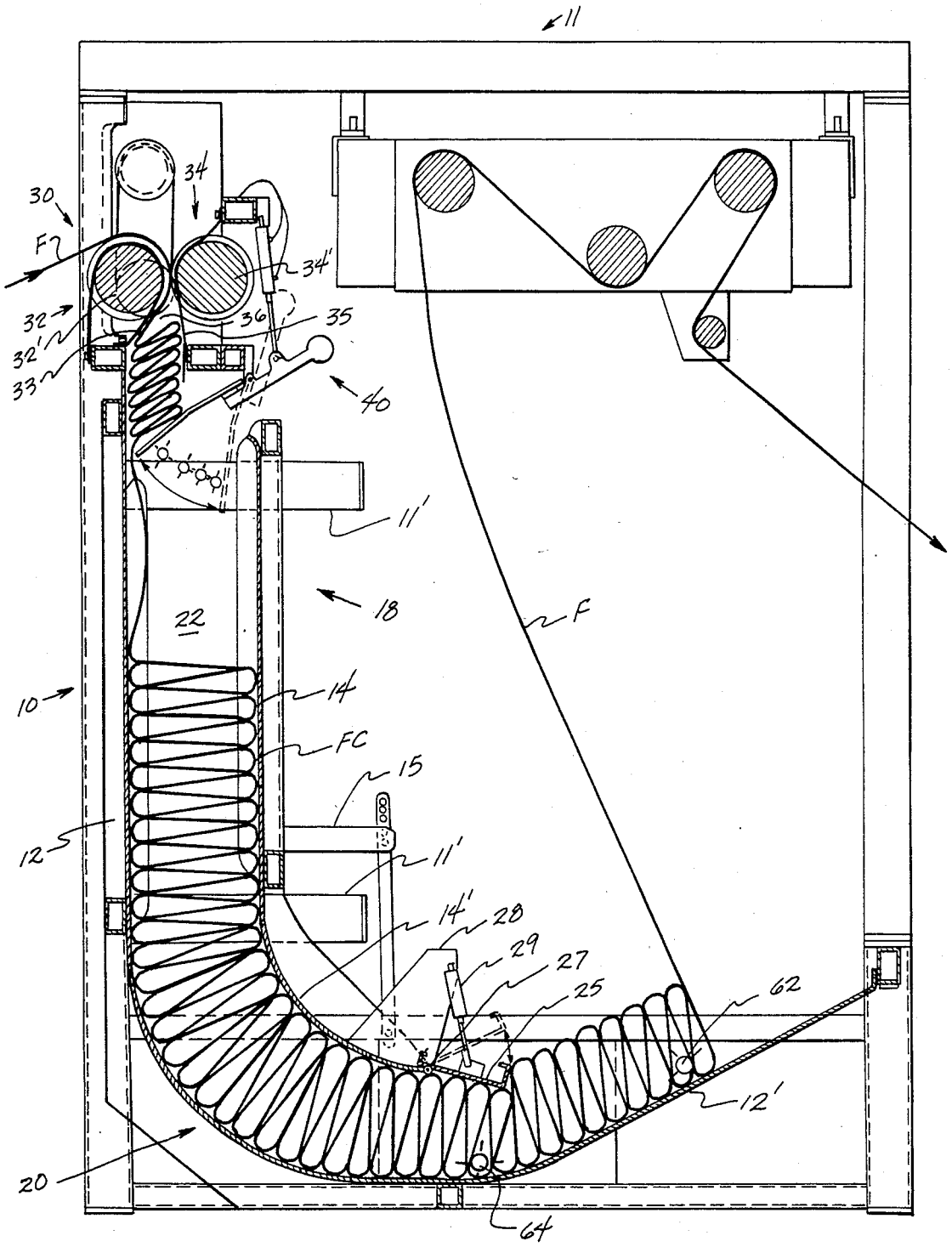
FIG. 1 is a vertical cross sectional view through the general overall height of a fabric accumulation system according to teachings of the present invention.

Referring to the Figures, preferred embodiments of the present invention will now be described in detail. The apparatus as shown in the Figures generally indicated as 10 is representative of the present invention. Such a system is normally deployed between two pieces of web handling equipment or processes, (not shown) to ensure proper continued operation of the equipment or process located downstream from same. Particularly, in the textile industry in which the present invention is intended for primary use, rolls of fabric are often fed to a process line where it is desirable to maintain continued operation of the process at varying speeds of operation. Obviously it is necessary during the operation to tie in new fabric rolls, and such should be accomplished without interruption of the operation of the process. In such situations, a device of the type of the present invention is placed between the two pieces of equipment or ahead of the downstream process to accumulate and store fabric in adequate quantity that the process continues to operate while a seam is being sewn between a trailing end of a first roll of a leading end of a second roll of fabric.

The web or fabric accumulation system 10 according to the present invention includes a framework 11 to which a back wall 12, a front wall 14, and side walls 16 are secured to define a housing generally indicated as 18, having an actuately curved bottom section generally 20. A fabric exit is provided at the end of curved front wall section 14' while a further back wall section 12' extends beyond curved bottom section 20, and serves as a fabric support plate. Walls of housing 18 thus define a fabric storage section 22 therewithin in which fabric may be accumulated prior to being withdrawn from fabric support 12' by withdrawal means generally 80.

As illustrated in FIG. 1, fabric F enters housing 18 at an upper end of same and forms a fabric column FC within storage section 22 which gravitationally forces the lower portion of the column through fabric exit onto fabric support 12' where same is lifted thereoff. Further, while the housing structure 18 as generally illustrated in FIG. 1, basically assumes the shape of the standard J box accumulator, it will become obvious from the description hereinafter, that such is not the case. As illustrated in FIG. 1, an adjustment mechanism 15 is provided to enable front wall 14 to be varied as desired for dimensioning the fabric storage section 22. Particularly in this regard, front wall 14 may be adjusted to provide clearance within housing 18.

Also as illustrated in FIG. 1, a door 25 is provided at a terminal end of arcuate wall section 14' and is pivotally connected at 27 to a support 28. A fluid operating cylinder 29 is associated with door 25 to open and close same. With such arrangement, door 25 may be positioned in a generally open configuration as depicted in FIG. 1 or following an arcuate path as indicated by the double headed arrow to a closed position (shown in phantom) which virtually obstructs the fabric exit from housing 10 and impedes a passage of fabric thereby. With pivotal door 25, gravitational movement of the fabric column FC may be enhanced or retarded as desired, depending upon fabric characteristics or other parameters of the process equipment with which the accumulation system is employed. Particularly control parameters for operation of door 25 will be described hereinafter.

Figure 3:
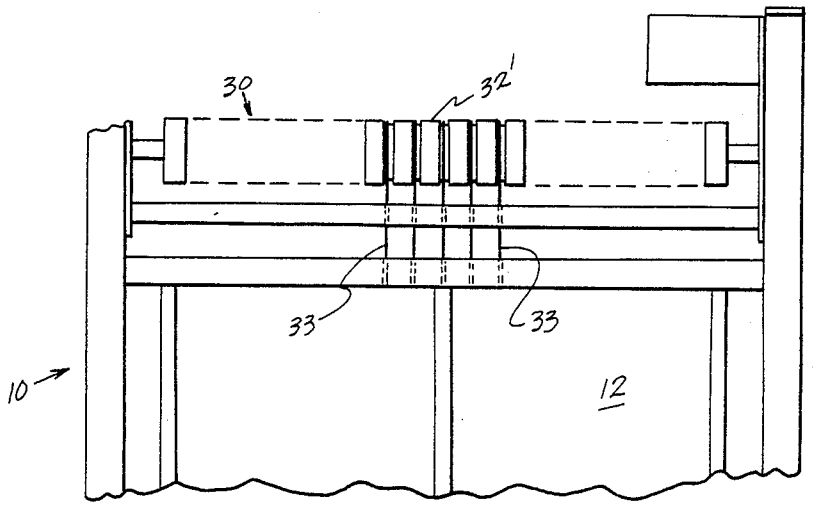
FIG. 3 is a partial elevational view of the system illustrated in FIG. 1 taken from a rear side of same.

A fabric feed means generally 30, is located atop housing 10 and preferably comprises a pair of nip rolls generallly 32, 34 which, as shown in FIG. 3, include a plurality of cots 32', 34' having strips of material 33, 35 located therebetween which are secured to portions of framework 11 on both sides of rolls 32 and 34 and preclude fabric F passing therebetween to wrap around either roll. Straps 33 and 35 further define front and back walls of a fabric packing area 36 as described immediately hereinafter. Located between fabric packing area 36 and the main fabric storage area 22 is a closure means generally 40 that is pivotally secured to a portion of housing 10 or an appurtenant framework structure. Closure means 40 moves between an open position where fabric may pass through packing area 36 directly into vertical storage area 22 unimpeded and a closed position, illustrated in solid lines in FIG. 1, where closure means 40 cooperates with strips 33 and 35 to define fabric packing area 36. Fabric F is fed by feed means 30 into packing area 36 where the fabric is compacted and folded prior to entry into vertical storage area 22.

Figure 2:
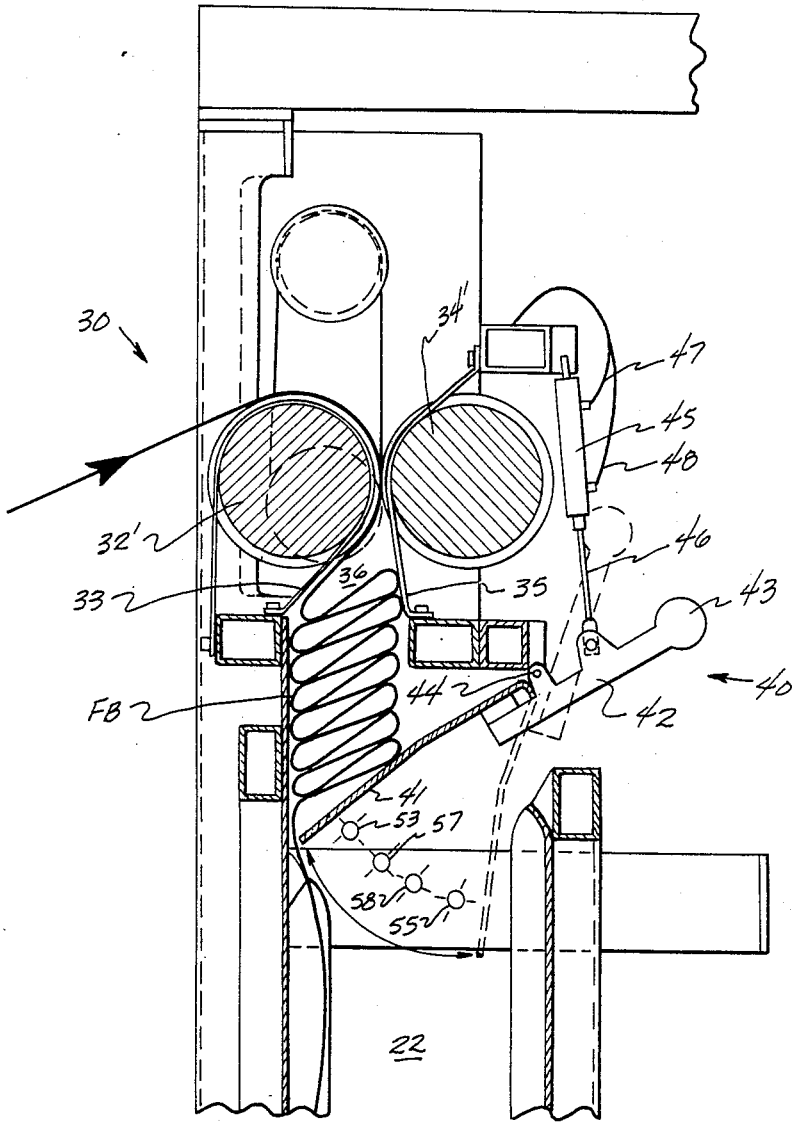
FIG. 2 is a partial vertical cross sectional view through a portion of the fabric housing in which fabric bundle buildup occurs prior to being deposited in unrestricted fashion into the lower portion of the fabric housing where fabric is accumulated.
Figure 4:
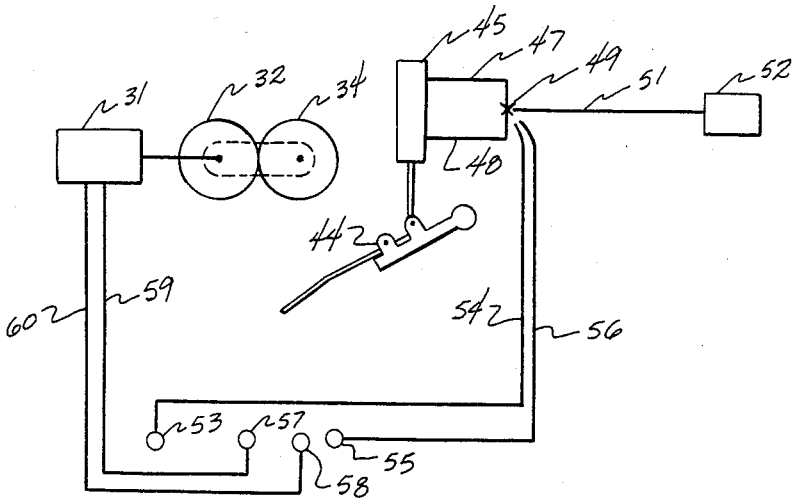
FIG. 4 is a schematic diagram of a control system for an accumulation system according to the teachings of the present invention.

As shown in the Figures, particularly FIG. 2, closure means 40 includes a plate 41 that is secured to a counterweight arm 42. Counterweight arm 42 is pivotally associated with housing 10 or framework 11 at pivot point 44 and has a counterweight 43 located at an outer free end of same. A fluid cylinder 45 having a rod 46 reciprocally movable therein is likewise secured to a portion of framework 11 while an outer end of rod 46 is pivotally secured to counterweight arm 42 intermediate the length of same. Actuation of cylinder 45 by the introduction of hydraulic or other fluid into an upper end via fluid line 47 forces rod 46 from within cylinder 45, depressing arm 42 and thus causing pivotal movement of plate 41 to a closed position. When plate 41 is closed, a portion of fabric F is trapped thereby while further portions of fabric F being fed by feed means 30 are received in fabric packing area 36 in an accordian folded condition against plate 41. Once the force of fabric F above plate 41 overcomes the fluid pressure within cylinder 45, initial displacement of plate 41 is made in the opening direction. A first sensor 53 is located immediately adjacent the closed position and is operatively associated with a fluid valve 49 (see FIG. 4) located in fluid supply line 51 between supply lines 47 and 48. Once sensor 53 detects the movement of plate 41, valve 49 is actuated to divert fluid from the upper side of cylinder 45 to a lower side of same via supply line 48. Rod 46 is then retracted into cylinder 45, causing upward pivotal movement of arm 42 and corresponding movement of plate 41 to the open position as shown in dotted lines in FIG. 2. Quick opening of the closure means 40 by actuation of sensor 53 enables the fabric bundle FB located above plate 41 to immediately drop into fabric storage area 22 atop prior bundles located therewithin. Once plate 41 reaches full open position, a further sensor 55 is actuated which is associated with fluid valve 49 to divert fluid again to the upper portion of cylinder 45 and thus bring about return pivotal movement of plate 41 to the closed position.

Cyclic operation of the closure means 40 as just previously described permits successive bundles FB of fabric to be deposited one after the other into fabric storage area 22 where the fabric in each bundle is properly compacted from side to side. As such, the selvedge problems experienced with prior art accumulation systems are avoided. Particularly, as the fabric column FC continues to build within storage 22 by the deposition of successive fabric bundles therewithin, smooth continous fabric withdrawal from exit E of the system is facilitated.

During initial startup of the fabric accumulation system and any time during which the fabric column FC is located only in a lower portion of fabric storage 22, feed means 30 is operating in a high speed mode which is roughly 1½ to 2½ times the rate of withdrawal of fabric F from fabric support 12'. As such, fabric column FC will continue to build within storage area 22 to a predetermined height. At the point where the fabric column FC precludes plate 41 from fully closing, the intermediate location of plate 41 between the open and closed position is detected by one of a plurality of sensors 57, 58 which are operatively associated via conductors 59, 60 respectively with drive motor 31 for feed means 30. Actuation of sensor 57 or 58 deactuates the high speed mode for motor 31 and institutes a control mode, during which motor 31 becomes a slave of the withdrawal means 80. Fabric being fed into housing 10 by feed means 30 is then maintained in a range of about 95 to about 125 percent of the speed of fabric withdrawl. Particularly, sensor 57 reduces the speed of drive motor 31 to a ratio of about 125 percent of the fabric withdrawal speed. Hence when sensor 57 is actuated, there is enough fabric in housing 18' to preclude full closure of closure means 40, but plate 41 crosses most of its path of travel. When sensor 58 is actuated, there is yet more fabric in housing 10, for plate 41 is stopped adjacent the full open position. Sensor 58 when actuated thus reduces fabric speed to about 95 percent of the speed of fabric withdrawal. Should, however, adequate fabric F be withdrawn from housing 10 that sensors 57 and 58 are no longer actuated, motor 31 returns to the high speed mode to again fill storage section 22 with fabric. While as set forth herein, in the slave control mode the fabric feed means 30 generally operates at a speed in a range of from about 95 to 125% of the speed of the withdrawal means, obviously any number of sensors may be provided such that an infinitely variable speed ratio is achievable.

Having basically described the apparatus of the present invention, the method of operating same will now be described. During start up of the apparatus, a forward or leading end of fabric F is fed into fabric storage area 22 via fabric feed means 30 and is removed from an lower, fabric exit end of same where it is threaded up to withdrawal means 80 for continous removal from within housing 18. In order, as mentioned above, to permit changing of fabric rolls, and splicing together a leading edge of a second roll to a trailing edge of the first, there must be adequate fabric storage within housing 18 to permit fabric withdrawal means to continue to operate in a uniform fashion. For this reason, fabric storage area 22 is provided. After the fabric leader has been fed through the accumulator system, the closure means 40 located atop storage area 22 is actuated to pivot plate 41 to the closed position. Fabric during the filling of storage area 22 is being fed to housing 18 in a high speed mode, i.e., roughly 1½ to 2½ times the speed of fabric withdrawal. Fabric F being fed and being restricted by plate 41 is thus compacted within fabric compaction area 36 to form a folded fabric bundle FB thereabove. Fluid cylinder 45 associated with the closure means 40 is preset at a predetermined pressure, and when the pressure of fabric F within compacting area 36 overcomes the pressure within cylinder 45, slight pivotal movement of plate 41 is made in the opening direction. After very short opening movement of plate 41, opening sensor 53 is actuated which in turn actuates fluid valve 49 and diverts fluids from supply 52 via supply lines 51 and 48 to a lower side of cylinder 45 to retract rod 46 and thereby quickly move plate 41 from the closed to the full open position. Fabric bundle FB is then permitted to drop as a bundle into fabric storage area 22 within housing 18 therebelow. Once plate 41 reaches full open position, a closing sensor 55 is actuated which is operatively associated with fluid valve 49 to divert fluid to the upper end of cylinder 45, thus reversing the operation and causing pivotal movement of plate 41 about pivot point 44 to the closed position which entraps fabric against the inside of housing wall 12 and redefines the fabric packing area 36 thereabove. This operation continues to cycle as described until the fabric column FC within fabric storage area 82 of housing 18 extends upwardly to a point where plate 41 is precluded from fully closing. The presence of plate 41 intermediate the open and closed positions actuates a control sensor 57 or 58, both of which are operatively associated with drive motor 31 by feed means 30. Sensors 57 and 58 signal motor 31 to change from the high speed mode to a slave mode during which the fabric feed rate is controlled by the rate of fabric withdrawal from housing 18. So long as a supply of fabric F remains adjacent plate 41, the system remains in the slave mode.

In an embodiment which includes exit gate 25, a pair of photocells 62, 64 or the like are located along fabric support 12' (see FIG. 1). So long as photocell 64 remains covered, the system continues to function. Covering of photocell 62 signals fluid cylinder 29 to close gate 25 whereby the fabric F on support 12' may be withdrawn without further fabric being fed thereon. Once photocell 62 is uncovered, gate 25 is reopened. Photocell 64, if uncovered signals an absence of fabrics in the system and shuts down the system.

Having described the present invention in detail it is obvious that one skilled in the art will be able to make variations and modifications thereto without departing from the scope of the invention. Accordingly, the scope of the present invention should be determined only by the claims appended hereto.

That which is claimed is:

1. Improved fabric accumulation apparatus comprising:

(a) fabric feed means;

(b) a housing, said housing having sidewalls defining a vertical fabric storage section, said housing defining a fabric entrance at an upper end thereof and a fabric exit at a lower end thereof whereby fabric may be accumulated in said storage section while awaiting being fed from said fabric exit;

(c) closure means associated with said housing between said feed means and said fabric storage section said closure means being adapted for movement between an open position where fabric may pass thereby and a closed position which defines a fabric packing section therabove; and (d) control means operatively associated with said closure means to move said closure means between said open and said closed positions, whereby when said closure means is in said closed position, fabric fed into said housing is compacted in said packing section, and whereby at predetermined intervals, said closure means will open, permitting said compacted fabric to drop thereby into said fabric storage section of said housing, and reclose.

2. Apparatus as defined in claim 1 wherein said closure means is pivotally associated with said housing.

3. Apparatus as defined in claim 2 wherein said control means comprises a fluid piston-cylinder arrangement, said piston being associated with said closure means to close same to pivotally move between an open and a closed position.

4. Apparatus as defined in claim 3 wherein said fluid piston-cylinder arrangement is adjustable whereby said closure means is held by a predetermined pressure in a closed position, and wherein fabric may be compacted thereagainst until fabric pressure on said closure means overcomes said predetermined pressure and said closure means is forced open.

5. Apparatus as defined in claim 4 wherein first sensor means are located along a path of travel of said closure means and are operatively associated with said fluid cylinder arrangement, whereby opening movement of said closure means actuates said first sensor means which in turn actuates said fluid cylinder arrangement to fully open said closure means and permit said compacted fabric to quickly drop thereby.

6. Apparatus as defined in claims 5 comprising second sensor means located along an opposite end of said path of travel of said closure means and associated with said fluid cylinder, said second sensor means being actuated by said closure means adjacent a fully open position which in turn actuates said fluid cylinder to quickly return said closure means to a closed position.

7. Apparatus as defined in claim 1 further comprising a fabric feed means positioned above and adjacent said fabric packing section.

8. Apparatus as defined in claim 7 wherein said fabric feed means comprises a pair of driven nip rolls, said nip rolls closing an upper end of said fabric packing section.

9. Apparatus as defined in claim 7 further comprising means for withdrawing said fabric from said housing through said fabric exit.

10. Apparatus as defined in claim 9 wherein further sensor means are located intermediate the length of said path of travel of said closure means and are operatively associated with said fabric feed means whereby once said fabric storage section becomes sufficiently full, said closure means will not fully return to a closed position and will actuate one of said further sensor means to switch said feed means to a slow speed mode in which the speed of said feed means is controlled by the speed of said fabric withdrawal means.

11. Apparatus as defined in claim 1 wherein a lower end of said housing defines an arcuate storage section, said fabric exit being located adjacent an end of said arcuate section.

12. Apparatus as defined in claim 12 wherein a gate means is located at said fabric exit, said gate means having means associated therewith to move same between an open and a closed position.

13. Apparatus for accumulating webs of indeterminant length such as fabrics and the like comprising;

(a) a housing, said housing having walls defining a vertically oriented web storage section having an arcuate lower end, a web entrance to said storage section at an upper end of same, and a web exit from said storage section at a lower end of same;

(b) web feed means located at an upper end of said housing adjacent said web entrance;

(c) closure means located at an upper end of said housing and being adaptable for movement between a closed position and an open position, said closure means in said closed position defining a web packing area thereabove;

(d) means for moving said closure means between said open and closed positions;

(e) first control means located along a path of travel of said closure release for actuating said closure moving means according to predetermined conditions; and (f) sensor control means located along said path of travel of said closure means and being operatively associated with said web feed means whereby, once said second control means are actuated, the speed of said web feed means is determined by the speed of web withdrawal from said housing.

14. Apparatus as defined in claim 13 wherein said housing is J shaped.

15. Apparatus as defined in claim 14 wherein said web feed means is a pair of nip rolls, said rolls defining an upper end of said web packing area.

16. Apparatus as defined in claim 13 wherein said closure means is an assembly associated with a portion of said housing for pivotal movement between said open and closed positions.

17. Apparatus as defined in claim 16 wherein said assembly comprises a closure plate and a counter weight member secured to said closure plate and extending outwardly therefrom, said counter weight member being pivotally secured to said housing, and wherein said closure moving means is associated with said counter weight member.

18. Apparatus as defined in claim 17 wherein said closure moving means is a fluid cylinder having an operating rod received for reciprocal movement therein, said rod being secured to said counter weight member on a side of said pivotal connection opposite said plate.

19. Apparatus as defined in claim 18 wherein said first control means comprise a plurality of sensor means, whereby said fluid cylinder is operatively controlled by location of said closure plate.

20. Apparatus as defined in claim 19 wherein a first sensor is located along said path of travel adjacent one end of same and a second sensor is located at an opposite end of said path.

21. Apparatus as defined in claim 20 wherein said first sensor is located adjacent said closed position, whereby one said plate is partially forced open by web thereabove, said cylinder is actuated to move said plate to the open position, permitting said web to drop into said storage section, and at the end of said path of travel said second sensor is actuated which actuates said cylinder to return said plate to the closed position.

22. Apparatus as defined in claim 21 wherein said second control means comprises at least one further sensor means located along said path of travel between said first and second sensor means, whereby when web builds up in said storage section to a point where said closure plate will not return to a fully closed position, said at lease one further sensor is actuated.

23. An improved method of handling fabric in a vertically oriented fabric accumulation system in which fabric is to be stored in folded form in a vertical fabric column with fabric being fed into said system at one end and withdrawn from said system at an opposite end, the rate of fabric feed being related to the rate of fabric withdrawal, comprising the steps of;

(a) feeding fabric into said system at a rate higher than the rate at which fabric is withdrawn from said system;

(b) interrupting fabric being fed at an upper portion of said system and compacting a predetermined amount of fabric into a fabric bundle thereat;

(c) releasing said fabric bundle and permitting said bundle to drop into a lower portion of said system to build up said fabric column thereat;

(d) immediately thereafter repeating steps (b) and (c) until said fabric column builds up to a predetermined height; and (e) thereafter controlling the rate of fabric being fed into said system proportional to the rate of fabric being withdrawn from said system to maintain an adequate accumulation of fabric within said system.

24. The method as defined in claim 23 wherein said fabric is interrupted by a closure means engaging same and said fabric bundle is compacted thereabove.

25. The method as defined in claim 24 wherein said fabric bundle is released by movement of said closure means from beneath same.

26. The method as defined in claim, 23 wherein said fabric is interrupted by pivotally moving a closure means across the path of travel of said fabric, said closure means entrapping fabric thereabove, where said fabric is compacted into a fabric bundle, and wherein said fabric bundle is released by removing said closure means from said path of fabric travel.

27. The method as defined in claim 26 wherein once said closure means is closed and a predetermined amount of fabric is compacted thereover, said fabric forces said closure means partially open to a point where actuating means act on said closure means to fully open same and permit said fabric bundle to drop thereby, after which said actuating means acts on said closure means to return same to the closed position for the production of a further fabric bundle thereover.

28. The method as defined in claim 23 wherein steps (b) and (c) are repeated until fabric in said column interferes with means for interrupting said fabric.

* * * * *